US009192542B2

(12) United States Patent
Blenk et al.

(10) Patent No.: US 9,192,542 B2
(45) Date of Patent: Nov. 24, 2015

(54) MASSAGE DEVICE

(76) Inventors: Udo Blenk, Berlin (DE); Stefan Stohr, Berlin (DE)

( * ) Notice: Subject to any disclaimer, the term of this patent is extended or adjusted under 35 U.S.C. 154(b) by 445 days.

(21) Appl. No.: 12/999,341

(22) PCT Filed: Jun. 16, 2009

(86) PCT No.: PCT/DE2009/000839

§ 371 (c)(1),
(2), (4) Date: Feb. 28, 2011

(87) PCT Pub. No.: WO2009/152813

PCT Pub. Date: Dec. 23, 2009

(65) Prior Publication Data

US 2011/0144426 A1 Jun. 16, 2011

(30) Foreign Application Priority Data

Jun. 16, 2008 (DE) ..... 10 2008 028 717

(51) Int. Cl.
*A61H 23/02* (2006.01)
*A61H 19/00* (2006.01)

(52) U.S. Cl.
CPC ..... *A61H 19/44* (2013.01); *A61H 23/02* (2013.01)

(58) Field of Classification Search
CPC ..... A61H 19/44; A61H 19/32; A61H 19/34; A61H 19/00; A61H 2201/0152; A61H 19/30; A61H 23/00; A61H 23/02; A61H 1/00
USPC ..... 600/38; 601/46, 70, 72
See application file for complete search history.

(56) References Cited

U.S. PATENT DOCUMENTS

| | | | | |
|---|---|---|---|---|
| 3,991,751 | A | 11/1976 | O'Rourke | |
| 4,377,692 | A | 3/1983 | Barry et al. | |
| 4,697,581 | A * | 10/1987 | Endo et al. | 601/78 |
| 5,434,549 | A | 7/1995 | Hirabayashi et al. | |
| 2002/0156402 | A1 * | 10/2002 | Woog et al. | 601/46 |

FOREIGN PATENT DOCUMENTS

| | | |
|---|---|---|
| CN | 85205738 | 12/1986 |
| CN | 2166809 | 6/1994 |
| CN | 2375027 | 4/2009 |
| DE | 2310862 | 9/1974 |

(Continued)

*Primary Examiner* — Christine H Matthews
(74) *Attorney, Agent, or Firm* — Karin L. Williams; Mayer & Williams PC

(57) ABSTRACT

The invention relates to a massage device having a device housing, an electromechanical arrangement arranged in the device housing for generating mechanical vibrations, an electronic controller for controlling the electromechanical arrangement, and a power source, connected to the electromechanical arrangement and the electronic controller. the electromechanical arrangement includes at least one coil element and at least one ferromagnetic core arranged parallel or coaxial with the coil element and a cylindrical member, wherein the at least one coil element surrounds the cylindrical member such that the at least one ferromagnetic core is coaxially guided through the cylindrical member, wherein the core has a mass m1, the mass ratio m1:m2 where m2 represents a total mass m2 of the massage device, and the mass ratio is in the range from 1:100 to 1:3. In operation, the massage device as a whole vibrates in a direction substantially parallel to a cylinder axis of the cylindrical member.

23 Claims, 1 Drawing Sheet

(56) References Cited

FOREIGN PATENT DOCUMENTS

Figure 1:
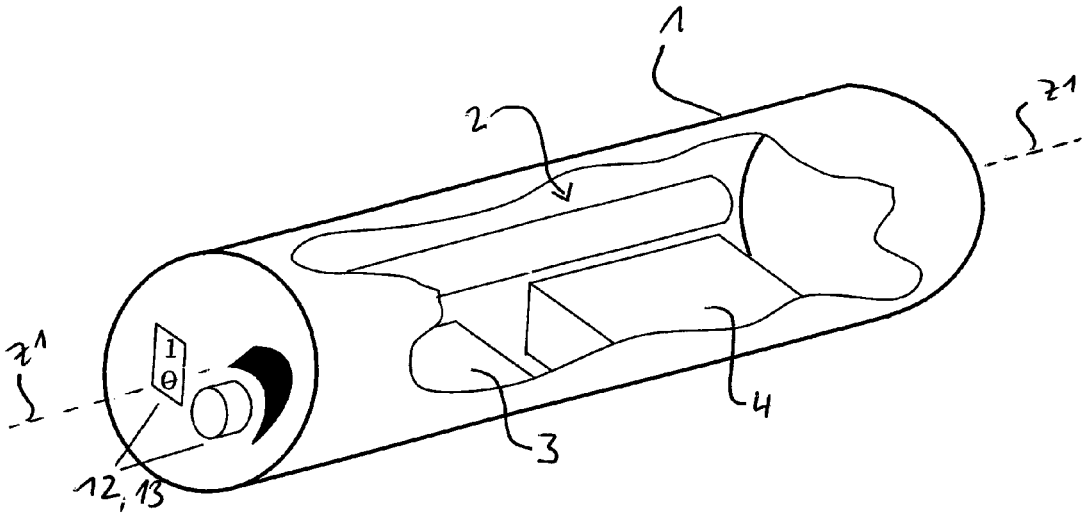

| | | | |
|---|---|---|---|
| DE | 2437053 | A1 | 2/1976 |
| DE | 19615557 | | 10/1998 |
| DE | 29913641 | | 3/2000 |
| DE | 102005042092 | | 10/2007 |
| DE | 10 2008 016959 | A1 | 11/2009 |
| FR | 2887144 | | 12/2006 |
| JP | H11168869 | | 6/1999 |
| JP | 2005-348815 | | 12/2005 |
| WO | 00/23030 | | 4/2000 |
| WO | 2005/041845 | | 5/2005 |
| WO | 2009/152813 | | 6/2009 |

* cited by examiner

MASSAGE DEVICE

FIELD OF THE INVENTION

The invention relates to a massage device, in particular for sexual stimulation, comprising an essentially cylindrical housing, with electromechanical means arranged in the housing for generating mechanical vibrations, along with electronic means arranged in the housing for activating the means for generating mechanical vibrations and with a power source, connected to the means for generating mechanical vibrations and the electronic means, wherein the means for generating mechanical vibrations comprise at least one coil element and at least one ferromagnetic core arranged parallel or coaxial with the coil element and movably guided parallel to a cylinder axis of the housing. Furthermore, the invention relates to the use of such a massage device for sexual stimulation.

PRIOR ART AND BACKGROUND OF THE INVENTION

Massage devices for sexual stimulation are for instance known from the documents U.S. Pat. No. 3,991,751 and U.S. Pat. No. 4,377,692. These are essentially devices replicating the shape and appearance of a male phallus, comprising means integrated therein for generating mechanical vibrations.

In the insofar known massage devices, the means for generating mechanical vibrations typically comprise an electric motor, on the shaft of which a vibration element with an unbalanced mass is attacked. Thereby, by rotation of the electric motor, a vibration is generated usually extending orthogonal to the longitudinal extension of the housing, since the shaft of the electric motor is arranged parallel to the housing axis. In the insofar known massage devices, vibrations with relatively high frequency and with low amplitude are produced. Further, a disturbing noise with the frequency of the vibrations occurs in most cases. All this is disadvantageous for the use of the massage device, since this will be regarded as rather annoying.

Massage devices of the type of construction mentioned above are for instance known from the documents DE 29913641 U1, DE 2310862 A and DE 19615557 A1. In the first document above, the means for generating mechanical vibrations are loudspeaker elements, the loudspeaker axis of which is parallel to or coaxial with the cylinder axis of the housing. Because of the use of loudspeakers, the generated vibrations have a relatively high frequency with minimum amplitude in the direction of the cylinder axis. In the subject matter of the DE 19615557, only a front end of the housing is set into vibrations and not the complete housing. Thus, the massage effect is rather low. In the subject matter of the document DE 2310862, the direction of the vibrations is not clear.

For massage devices for the above purposes, it is generally desirable that on the one hand the massage device itself vibrates as a whole, that on the other hand these vibrations have a relatively high amplitude, and finally that the vibrations take place in the directions parallel to the housing axis of the cylindrical housing, since this results in an appreciably improved massage effect. Further, it is desirable that such a massage device can be operated very silently, preferably practically inaudibly.

TECHNICAL OBJECT OF THE INVENTION

It is therefore the technical object of the invention to specify a massage device, which as a whole carries out vibrations of relatively high amplitude in the directions parallel to the housing axis, and with a low frequency and practically noiseless at that.

BASICS OF THE INVENTION AND PREFERRED EMBODIMENTS

For achieving this technical object, the invention teaches that the core has a mass m1, the mass ratio m1:m2 of which to the total mass m2 of the massage device is in the range from 1:100 to 1:3.

By dimensioning the mass ratios according to the invention, it is on the one hand achieved that the massage device, caused by its inertia, will as a whole carry out a vibration in the directions parallel to the cylinder axis of the housing, and with a substantial amplitude at that. Furthermore, the means used according to the invention for generating mechanical vibrations can be operated practically inaudibly and in frequency ranges being advantageous for massage purposes. Finally, the massage movements of a massage device according to the invention correspond to rather natural movements compared to prior art massage devices.

It is preferred if the mass ratio m1:m2 is in the range from 1:50 to 1:3, in particular 1:20 to 1:3 or 1:10 to 1:3 or 1:5. In these connections it is useful if the mass m1 is in the range from 10 to 300 g, preferably 15 to 200 g, most preferably 10 to 100 g. For the purpose of the invention it is preferred if the amplitude of the cores in the directions parallel to the cylinder axis is in the range from 5 to 150 mm, preferably 10 to 100 mm, most preferably 10 to 60 mm.

Further, it is preferred for the purpose of the invention if the electronic means activate the means for generating mechanical vibrations with a frequency in the range from 0.1 to 50 Hz, preferably 0.1 to 20 Hz, most preferably 0.3 to 10 Hz, in particular 0.3 to 5 or to 10 Hz.

For all above parameters, the lower and/or upper limits of the different ranges of the same parameter can however also be combined in an arbitrary manner.

In principle, the means for generating mechanical vibrations can be freely configured. Any electromechanical linear drive, which can be controlled with regard to direction, amplitude and frequency according to the above parameters, can be used. It is preferred, however, if the means for generating mechanical vibrations comprise: a cylindrical member, in which the core is arranged parallel to a cylindrical member axis, in particular coaxial with the cylindrical member axis, at least one excitation coil, the coil axis of which is arranged coaxial with the cylindrical member and surrounds the cylindrical member, and one elastically deformable impact element each at each end of the cylindrical member and in the interior thereof. The cylindrical member axis is essentially parallel or coaxial with the cylinder axis of the housing. It is a matter of course that the cylindrical member is suitably made of materials, the magnetic permeability of which is smaller than 10, in particular than 2. For this purpose, for instance materials made of organic polymers can be used, but also metal materials, such as for instance aluminum. The core may be just ferromagnetic, it may however also be (permanently or non-permanently) magnetized. The elastically deformable impact elements in the interior of the cylindrical member and at its ends limit the amplitude of the cores and attenuate its impact at the ends of the cylindrical member. Practically all rubber-elastic materials can be used, however also essentially elastically deformable foams made of organic polymers.

Alternatively to impact elements, it may be provided that the core is suspended in a spring-elastic manner about a preferably central (referred to the cylindrical member) rest position. Both ends of the core can be connected in a friction-locked manner by a spring element with the ends of the cylindrical member. However, there may also be one spring element only that connects one end of the core with one end of the cylindrical member. Spring elements may in principle be all springs used in the field of mechanics, tension as well as compression springs, for instance helical springs made of metal or organic/polymeric materials, but also rubber-elastic bands and the like.

In a preferred embodiment, two excitation coils being coaxial with each other and spaced in the direction of the cylindrical member axis are provided. Energy is alternately applied to these coils, so that the core will be attracted in the opposite direction from the respective end position of the stroke. In the case of a magnetized core, the two coils are supplied with a polarity being opposed to the core.

Suitably, the cylindrical housing comprises an outer wall made of a physiologically compatible material. For this purpose, in principle all polymeric materials being usual in medical devices can be used, in particular also silicone plastic materials, latex, polyolefins and the like.

It is useful if an inner wall of the cylindrical member and/or an outer wall of the core has a slide coating. Thereby, static and sliding friction between core and inner wall of the cylindrical member are reduced, so that the energy demand of the coil is lower. For this purpose, basically all slide coatings being usual in mechanics can be used, wherein suitably static friction coefficients of <0.2 between the sliding surfaces are provided. An example for such a slide coating includes polyolefins and fluorinated hydrocarbons, in particular PTFE. Alternatively, it is of course also possible to guide the core in the cylindrical member by means of a linear roller bearing or the like. Instead of a slide coating, or additionally, conventional lubricants, liquid or paste-like, can also be used. Among these are in particular oils and greases based on hydrocarbon or silicone.

Suitably, the power source is a replaceable battery or accumulator. In the latter case, it is recommendable that the electronic means additionally comprise an electronic charging device for the accumulator, whereby the accumulator of the massage device can be recharged after use by a conventional power supply. For this purpose, the housing includes an electrical plug connection for connection of the charging device. Alternatively to a plug connection, means for wireless charging can be provided, for instance an induction loop integrated in the massage device. For charging, the massage device is then introduced into a charging station, which in turn comprises inductive means for supplying electrical energy.

It is further preferred, if the electronic means are connected with at least one control assembly, by means of which frequency and/or amplitude of the mechanical vibrations of the core can be adjusted and controlled in steps or continuously. These control assemblies can be arranged in or at the massage device or in the region of an end of the housing or of a front face of the housing and can be intended for manual control. In the simplest case, these are one or several rotary knobs, for instance potentiometers, but also up/down keys and the like are possible in particular in connection with a processor-controlled electronic system. Alternatively it is however also possible that control assemblies are arranged spaced from the housing and connected by wires or wireless with the electronic means. In the latter case, a receiver is integrated in the housing, said receiver being provided for the communication with a separate transmitter, and then the transmitter comprises the manually operable control assembly.

The term essentially cylindrical housing is not restricted to the exact cylindrical shape. Rather, the cross section may differ from the circular shape. Furthermore, the cylinder axis may be non-linear. Finally, at least one cylinder front face is preferably not plane, but rounded, and in particular for instance replicating the front end of a male phallus. Further, the outer surface of the housing may not only be smooth, but may comprise a topography, for instance with regular or irregular nubs.

Figure 2:
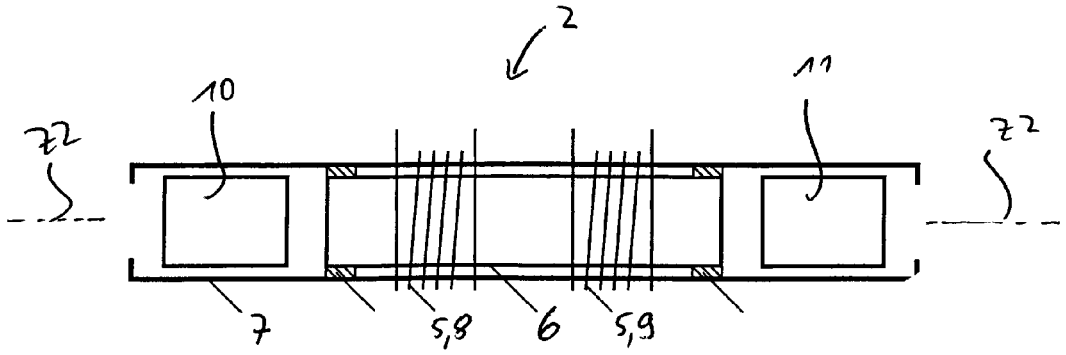

In the following, the invention is explained in more detail with reference to figures representing an example of execution only. There are:

FIG. 1: an outside view of a massage device according to the invention, partially cut open, and FIG. 2: a schematic cross section of a vibration generator used according to the invention.

In FIG. 1 can be seen that the massage device comprises an essentially cylindrical housing 1. In the housing 1, electromechanical means 2 for generating mechanical vibrations are arranged. Furthermore, the housing comprises electronic means 3 for activating the means 2 for generating mechanical vibrations. Finally, a power source 4 is provided in the housing 1, said power source being connected with the means 6 for generating mechanical vibrations and with the electronic means 3.

From FIG. 2 can be taken that the means 2 for generating mechanical vibrations comprise at least one coil element 5, in the example of execution with excitation coils 8, 9, and a movably guided ferromagnetic core 6. In particular, a cylindrical member 7 is provided, which has a magnetic permeability of approx. 1, and in which the core 6 is guided parallel to a cylindrical member axis Z2.

A comparison of FIGS. 1 and 2 shows that the cylindrical member axis Z2 extends parallel to the cylindrical member axis Z1. Thereby, the core 6 moves parallel to the cylinder axis Z1 and is guided in the cylindrical member 7. Different from the representation of FIG. 1, the cylindrical member axis Z2 may also be coaxial with the cylinder axis Z1. From FIG. 1 can be further taken that a control assembly 12 adapted as a rotary knob is provided at one end of the housing 1, by means of which the frequency and/or amplitude of the mechanical vibrations of the core 6 can be adjusted and controlled. Furthermore, an on/off switch 13 is provided.

It is a matter of course for the purpose of the invention that the cylindrical member 7 is preferably rigidly connected with the housing 1. Thereby, the mechanical vibration of the core 6 is transferred in an optimum manner to the housing 1 as a whole.

Coming back to FIG. 2, it can be seen that two excitation coils 8, 9 being coaxial with each other and spaced in the direction of the cylindrical member axis Z2 are provided. Furthermore, elastically deformable impact elements 10, 11 arranged on the inner side and at each end of the cylindrical member 7 can be seen. In the case of a magnetized core 6, the two excitation coils 8, 9 are activated alternately and with opposed polarity by the electronic means 3. The impact elements 10, 11 are made for instance of a foam material.

A massage device according to the invention typically comprises a core 6 with a mass m1 in the range from 10 to 300 g, in particular 15 to 200 g, preferably 20 to 80 g. The total mass m2 of the massage device is typically in the range from 100 to 1,000 g, in particular from 150 to 500 g, preferably from 200 to 400 g. The electronic means 3 activate the means 2 for generating mechanical vibrations with a frequency typically in the range from 0.3 to 5 Hz. Then, typically, the activation of the excitation coils 8, 9 occurs with a rectangular function or a trapezoidal function with high edge steepness.

Thereby, high accelerations of the core 6 and respective counter-movements of the housing 1 are induced. The amplitude H of the core in the directions parallel to the cylinder axis is typically in the range from 5 to 150 mm. The amplitude H of the vibrating core 6 corresponds to the distance of the opposing surfaces of the impact elements 10, 11 minus the longitudinal extension of the core 6 in the direction of the cylindrical member axis Z2. Preferably, the amplitude is in the range from 20 to 80 mm.

In the following, the invention is once again explained in other words.

The aim of the invention is the design of a small, compact and mobile device that permits without mechanical coupling to the environment that the user can independently vary the movement components frequency and amplitude in the longitudinal direction of the rod-shaped massage device. The massage device consists of the special device 1 that is accommodated in a housing that corresponds with regard to shape and material to the various usual vibrator housings.

It is the object of the invention to provide in a simple way a mobile device having the following features. Main components are the vibration generator and the electronic control system, advantageous embodiments result from the further explanations.

The object is essentially achieved by that the electronic control system supplies the coils of the vibration generator temporarily with electrical energy such that the magnetized armature is accelerated in such a manner that the forces thus generated set the massage device into the desired movement and as a result act sexually stimulating. The kind of the repeated movement is predetermined by the user by control elements.

The invention is explained in more detail with reference to an example of execution shown in the annexed drawings.

In FIG. 1 is shown an embodiment with a conventional housing of a massage device, which among others receives the vibration generator.

FIG. 2 shows a section of the vibration generator.

The massage device 12 acting in a massaging manner by oscillating, axial movements essentially consists of a housing 1, which houses in a first embodiment the vibration generator 2, the electronic control system 3, the control elements 12, 13 and the energy supply 4.

The oscillating, axial movement of the massage device is effected, according to the invention, by the vibration generator 2, by that the magnetized armature 6 is accelerated in the tube 7 by the magnetic field generated by the coils 8, 9. The forces caused by the acceleration of the armature serve for generating an oscillating, axial movement of a massage device, by that the vibration generator 2 is attached in a positive-locked and friction-locked manner in the housing 1.

The vibration generator 2 consists in the shown embodiment of a plastic or metal tube 7 being partially closed at the ends, in which the magnetized armature 6 is supported in an axially movable manner. In the outer regions of the tube 7, spring-damper elements 10, 11 may be arranged, which promote the repeating movement of the armature about its rest position. The magnetized armature is accelerated by magnetic fields generated by the coils 8, 9. These coils 8, 9 are disposed on the outside of the tube, as is shown in FIG. 2. The distance of the coils 8, 9 is variable and results from the dimensions of the individual components of the vibration generator 2. The friction of the movable armature 6 in the tube 7 can be reduced by various usual methods, such as for instance by roller bearings and Teflon films. A particularly advantageous embodiment is that only one coil 8, 9 is arranged around the tube 7, which is addressed correspondingly by the electronic control system. In the shown embodiment, the armature 6 is a permanent magnet. An improvement of the device is that the magnetized armature 6 is an iron rod, which is magnetized by one or several solenoids and electrical energy.

By the control elements 12, 13, the user determines the kind of the oscillating, axial movement of the massage device. The electronic control system 3 activates the coils 8, 9 of the vibration generator such that the armature 6 is accelerated in a way that the generated translational movement of the massage device corresponds to the user settings. In the shown embodiment, a switch 13 for activating the device and a rotary knob 12 for varying the frequency or amplitude are at the user's disposal, as shown in FIG. 1.

By the switch 13, the circuit from the energy supply 4 via the electronic control system 3 to the coils 8, 9 is closed, and by the knob 12, the frequency or amplitude, respectively, can be adjusted, with which the armature 6 moves about the rest position. A particularly advantageous improvement is that the user can choose from a manifold series of pre-defined types of movements, as described, and the electronic control system addresses the coils in a way that the desired types of movements of the massage device are automatically generated. It is advantageous that by the vibration generator 2, the axial movements can be varied separately in frequency and generated amplitude at the device 13. For this purpose, the electronic control system specifies the respective chronological activation of the coils. As additional features, the massage device may comprise an acoustic and/or optical switch and/or regulator and be provided with a remote control.

In the shown example of execution, the energy supply consists of accumulators, which are arranged in a battery compartment in the housing 1, see FIG. 1. An operation with batteries is also possible, such as for instance commercial alkali batteries. The housing preferably comprises a separate battery reception chamber. The accumulators may either be removed from the battery compartment for recharging, or a charging device is connected by a detachable plug connection or the charging energy is transferred by an inductive bridge. A particularly advantageous improvement is that separate battery units, power supplies or solar cells may be assigned to the massage device.

The force for generating the movement of the massage device is formed in the vibration generator 2. Suitably, the positive-locked and friction-locked attachments of the vibration generator 2 are disposed at the housing 1, preferably by a mechanical attachment device, for instance by screw or adhesive connections.

In the shown example of execution, the housing 1 is made of plastic, which has, with regard to the intended use as a massaging rod, a sufficient rigidity. In the housing wall are arranged the control elements 12, 13. The energy supply is suitably accommodated in a separate battery compartment, which has a reclosable opening in the housing 1. In the shown example of execution, the battery compartment is configured such that every single battery 4 comprises a holder. The housing 1 carries the electronic control system 3, in which the printed-circuit board is mechanically held in the interior of the housing. Particularly advantageous improvements are among others that the housing 1 a receives a conventional coating of a soft material, and that conventional vibrators (rotating unbalanced mass) are additionally included. Furthermore, the energy supply is arranged in the housing 1 such that the battery compartment does not have any openings and thus a water-tight design is obtained.

For achieving an optimum massage result, various shaped pieces can be arranged on the housing 1, differing by the surface texture. The surface texture may be from smooth, slightly ribbed to nubbed and is based on commercially available designs of respective massage devices. As material for the shaped pieces, latex, skin-friendly silicone or any other soft-elastic material can be used.

To sum up, the advantages of the invention over prior art are listed in the following.

Some conventional devices generate vibrations of massage devices by arranging an (unbalanced) mass eccentrically to a motor-driven shaft. These usual vibrators permit due to the type of generation of vibrations caused by their construction by unbalanced masses driven by an electric motor only one kind of massage, which normally is based on movements directed radially to the longitudinal direction of the housing. In these devices, the movement components frequency and amplitude always depend from each other. The device presented here permits, due to the special vibration generator 2, an oscillating, axial movement of a massage device, wherein the movement components frequency and amplitude can be varied independently from each other. This permits, compared to conventional vibrators, a wide variety of ways of massaging.

The device presented here comprises because of the special vibration generator 2 a very small and compact construction and permits thus, compared to known external devices for generating oscillating, axial movements of dildoes, a position-independent application, so that an optimum massage effect coming closest to the natural sexual movements is achieved. Furthermore, the device produces little noise and permits the generation of most various axial movement patterns.

Due to the use of the special vibration generator 2, the force required for the generation of a movement of the massage device is produced by the acceleration of the internal magnetized armature 6, thus a coupling of the device with the environment not being necessary. Some conventional devices generate an axial movement at the connected dildo by that relative displacements between a fixed point, for instance the bed cover or the manual fixation by the user, and the device are caused. Thus, the device presented here for the oscillating, axial movement of the massage rod can be used in a more universal way with regard to the position-independent use and can further more easily be handled by the user.

In particular, the invention can be defined as follows:

1. A device 1 for the generation of oscillating, axial movements of a massage device, which can be used for the stimulation and massage of the erogenous zones, characterized by following features:

1.1 The device accommodated in a housing corresponding to the shape and the material of the various usual vibrator housings mainly consists of: a vibration generator 2, an electronic control system 3, control elements 12, 13 and an energy supply 4.

1.2 The force required for the generation of an oscillating, axial movement of the massage device is produced by the vibration generator 2 by that the magnetized armature 6 is axially accelerated in the tube 7 by the magnetic field generated by the coil 8, 9.

1.3 The coil(s) 8, 9 of the vibration generator is (are) addressed by the electronic control system 3 such that the generated movement of a massage device corresponds to the settings selected by the user by means of the control elements 12, 13.

2. The device as above, characterized by that for the generation of oscillating, axial movements of a massage device, a coil or several coils and one or several spring-damper elements 10, 11 are arranged at or in the tube 7, respectively, of the vibration generator 2. The tube 7 and the armature 6 have a round or angular cross section. In a housing 1 corresponding in its shape and material to the various usual vibrator housings, one or several vibration generators 2 are used.

3. The device as above, characterized by that the energy supply 4 for the electronic control system 3 and the vibration generator 2 consists of batteries, accumulators, solar cells, a power supply or the like, which can be accommodated in the housing of the massage device. A charging device for charging the accumulator may be assigned to the energy supply.

4. The device as above, characterized by that the coil(s) 8, 9 of the vibration generator 2 is (are) addressed by the electronic control system such that the kind of the oscillating, axial movement of a massage device is adjusted with regard to the frequency, the vibration amplitude and a combination of frequency and vibration amplitude with the control elements 12, 13 or further control elements.

5. The device as above, characterized by that the magnetized armature 6 is a permanent magnet or a metal rod magnetized by one or several coils and electrical energy.

6. The device as above, characterized by that the electronic control system 3 is activated by an acoustic and/or optical switch and/or regulator. Operation of the device may also be made by a remote control.

7. The device as above, characterized by that the coil(s) 8, 9 of the vibration generator 2 is (are) addressed by the electronic control system such that the generated oscillating, axial movement of a massage device is automatically adjusted according to the optimum frequency (for instance natural frequency), the maximum vibration amplitude, an energy-optimized movement, a random movement or the like.

The invention claimed is:

1. A massage device comprising:

a device housing;

an electromechanical arrangement disposed in the device housing for generating mechanical vibrations;

an electronic controller for controlling the electromechanical arrangement; and a power source, electrically coupled to the electromechanical arrangement and the electronic controller, wherein the electromechanical arrangement includes at least one coil element, at least one ferromagnetic core arranged parallel or coaxial with the at least one coil element, and a cylindrical member, wherein the at least one coil element surrounds the cylindrical member such that the at least one ferromagnetic core is coaxially guided through the cylindrical member, wherein the core has a mass m1, and a mass ratio m1:m2, where m2 represents a total mass of the massage device, and the mass ratio is in the range from 1:100 to 1:3, wherein in operation, the massage device as a whole vibrates in a direction substantially parallel to a cylinder axis of the cylindrical member.

2. The massage device according to claim 1, wherein the mass ratio m1:m2 is in the range from 1:50 to 1:3.

3. The massage device according to claim 1, wherein the mass ratio m1:m2 is in the range from 1:20 to 1:3.

4. The massage device according to claim 1, wherein the mass ratio m1:m2 is in the range from 1:10 to 1:3.

5. The massage device according to claim 1, wherein the mass m1 is in the range from 10 to 300 g.

6. The massage device according to claim 1, wherein the mass m1 is in the range from 15 to 200 g.

7. The massage device according to claim 1, wherein the mass m1 is in the range from 20 to 80 g.

8. The massage device according to claim 1, wherein the amplitude of the core in a direction parallel to the cylinder axis is in a range from 5 to 150 mm.

9. The massage device according to claim 1, wherein the amplitude of the core in a direction parallel to the cylinder axis is in a range from 10 to 100 mm.

10. The massage device according to claim 1, wherein the amplitude of the core in a direction parallel to the cylinder axis is in a range from 10 to 60 mm.

11. The massage device according to claim 4, wherein the electronic controller activates the electromechanical arrangement to generate mechanical vibrations with a frequency in the range from 0.1 to 50 Hz.

12. The massage device according to claim 4, wherein the electronic controller activates the electromechanical arrangement to generate mechanical vibrations with a frequency in the range from 0.1 to 20 Hz.

13. The massage device according to claim 4, wherein the electronic controller activates the electromechanical arrangement to generate mechanical vibrations with a frequency in the range from 0.3 to 10 Hz.

14. The massage device according to claim 1, wherein the device housing comprises an outer wall made of a physiologically compatible material.

15. The massage device according to claim 1, wherein the power source includes a battery or an accumulator.

16. The massage device according to claim 1, wherein the electronic controller includes an electronic charging device for the accumulator.

17. The massage device according to claim 1, further comprising at least one control assembly operatively coupled to the electronic controller to adjustably control a frequency and/or amplitude of mechanical vibrations of the core.

18. The use of a massage device according to claim 1 for sexual stimulation, comprising:

switching on the massage device; and bringing the massage device into contact with a sexually stimulable body part of a person.

19. A massage device comprising:

a device housing;

an electromechanical arrangement disposed in the device housing for generating mechanical vibrations;

an electronic controller for controlling the electromechanical arrangement; and a power source, electrically coupled to the electromechanical arrangement and the electronic controller, wherein the electromechanical arrangement includes at least one coil element and at least one ferromagnetic core, wherein the core has a mass m1, and a mass ratio m1:m2, where m2 represents a total mass of the massage device, and the mass ratio is in the range from 1:100 to 1:3, and, wherein the electromechanical arrangement further comprises:

a cylindrical member in which the at least one ferromagnetic core is guided parallel to a cylindrical member axis of the cylindrical member;

the at least one coil element, having a coil axis and arranged coaxial with the cylindrical member and surrounding the cylindrical member; and an elastically deformable impact element located at each end of the cylindrical member and internal thereto, wherein the massage device as a whole vibrates in a direction parallel to the cylindrical member axis of the cylindrical member.

20. The massage device of claim 19 wherein the core is guided coaxially to the cylindrical member axis.

21. The massage device according to claim 19 further comprising two excitation coils being coaxial with each other and spaced in a direction of the cylindrical member axis.

22. The massage device according to claim 19, wherein an inner wall of the cylindrical member and/or an outer wall of the core has a slide coating.

23. A massage device comprising:

a device housing;

an electromechanical arrangement disposed in the device housing for generating mechanical vibrations;

an electronic controller for controlling the electromechanical arrangement; and a power source, electrically coupled to the electromechanical arrangement and the electronic controller, wherein the electromechanical arrangement includes:

at least one coil element and at least one ferromagnetic core arranged parallel or coaxial with the at least one coil element, and a cylindrical member having a cylindrical member axis, wherein the at least one coil element surrounds the cylindrical member, and the at least one ferromagnetic core is guided parallel to the cylindrical member axis, and wherein the core has a mass m1, and a mass ratio m1:m2, where m2 represents a total mass of the massage device, and the mass ratio is in the range from 1:100 to 1:3.

* * * * *